350-1.1 SR
11/14/78 XR 4,125,775

United States Patent [19] [11] 4,125,775
Chodak [45] Nov. 14, 1978

[54] SOLAR SIMULATOR

[75] Inventor: Jan B. Chodak, Painted Post, N.Y.

[73] Assignee: Corning Glass Works, Corning, N.Y.

[21] Appl. No.: 839,496

[22] Filed: Oct. 5, 1977

[51] Int. Cl.[2] ..... F21V 9/02
[52] U.S. Cl. ..... 250/504; 350/1.1; 362/1
[58] Field of Search ..... 33/1 DD; 35/1; 250/504; 350/1.1; 356/51; 362/1, 2

[56] References Cited

U.S. PATENT DOCUMENTS

| | | | |
|---|---|---|---|
| 2,725,461 | 11/1955 | Amour | 362/1 |
| 3,188,218 | 6/1965 | Elmer | 362/2 X |
| 3,202,811 | 8/1965 | Hall | 362/2 |
| 3,355,982 | 12/1967 | Rendina | 356/51 |
| 3,366,789 | 1/1968 | Allen | 250/504 X |

*Primary Examiner*—Harland S. Skogquist
*Attorney, Agent, or Firm*—Kees van der Sterre; Clinton S. Janes, Jr.; Clarence R. Patty, Jr.

[57] ABSTRACT

A solar simulator comprising an $SnO_2$-containing glass ultraviolet absorption filter in combination with a xenon arc light source, which simulator closely approximates the characteristics of the terrestrial solar spectrum at violet and ultraviolet wavelengths, is described.

3 Claims, 1 Drawing Figure

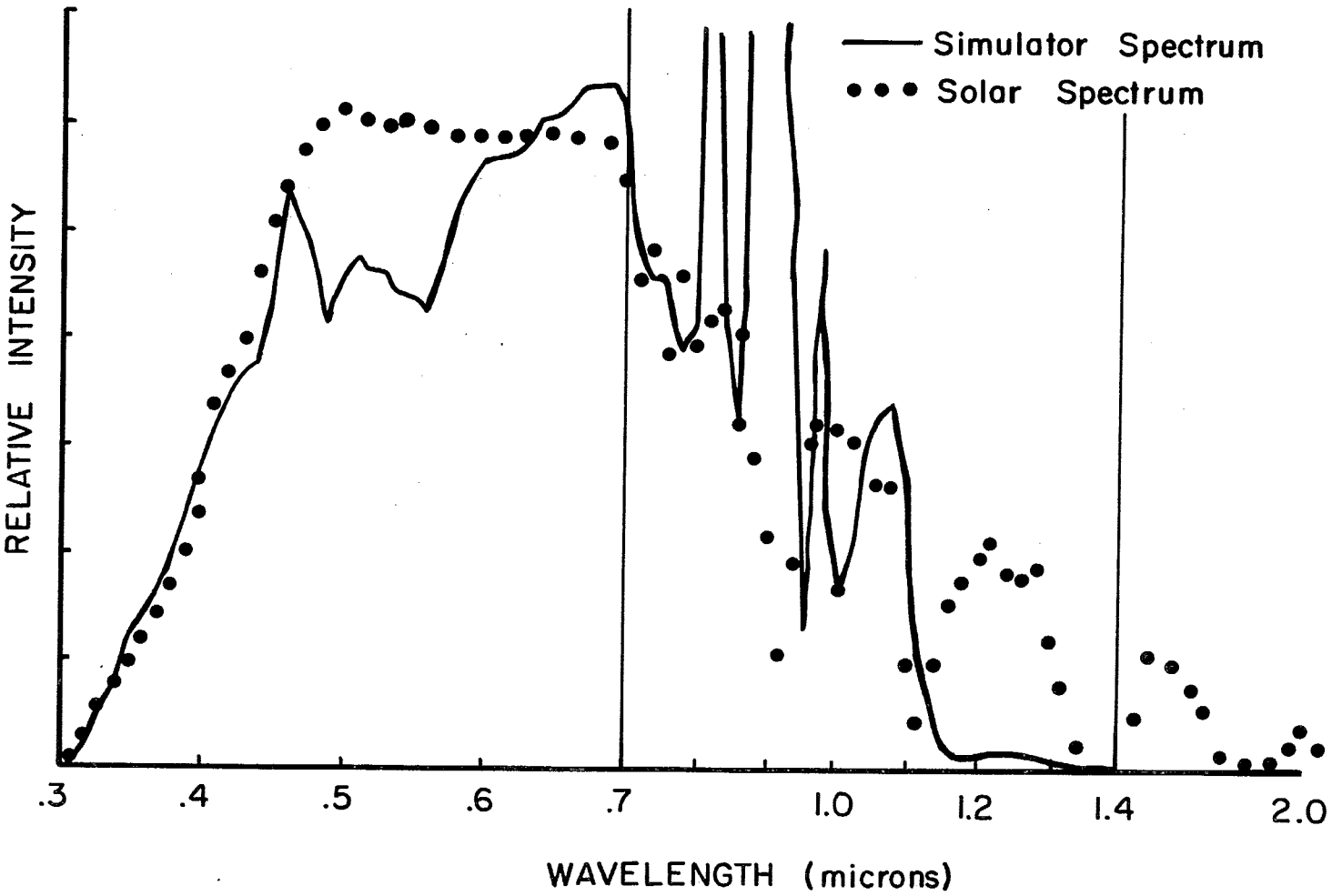
Simulator Spectrum
Solar Spectrum
RELATIVE INTENSITY
.3
.4
.5
.6
.7
1.0
1.2
1.4
2.0
WAVELENGTH (microns)

SOLAR SIMULATOR

BACKGROUND OF THE INVENTION

The present invention relates to apparatus for simulating solar radiation, and particularly to a solar simulator which closely approximates the characteristics of the violet and near ultraviolet portions of the solar spectrum at the earth's surface.

Solar simulators have been developed in order to provide convenient sources of radiation which can reproducibly provide the equivalent of sunlight on demand and without concern for variables such as weather conditions and sun position. Commercially-available simulators typically comprise high-pressure xenon arc lamp, a light source providing continuous radiation (with superimposed xenon emission lines) which, after filtration to reduce excessive infra-red and ultraviolet power, is used as artificial sunlight.

For applications such as the testing of organic plastics, dyes, photochromic glasses and the like, it is quite important to accurately reproduce sunlight in the ultraviolet and violet portions of the terrestrial solar spectrum, since these portions have the largest effect on the performance of such materials. Under average terrestrial sunlight conditions, taken to be sunlight at sea level with the sun 30° above the horizon, solar power is largely concentrated in the visible and near infrared, and decreases rapidly in the near ultraviolet to effectively terminate at a wavelength of about 0.3 μm.

This spectral termination of sunlight in the near ultraviolet is reproduced in some presently available solar simulators through the use of a filter, e.g., an interference filter, which reduces the irradiance of the simulator at wavelengths below 0.3 μm to negligible values. However, correspondence between such simulators and sunlight in the wavelength region from 0.3 μm to about 0.45 μm is still not as good as would be desired, particularly where excess radiation is emitted in the 0.3–0.4 μm range.

Even when a relatively good correspondence with sunlight is obtained, a deterioration in simulator performance may be observed over a period of time. Some of this deterioration may be attributed to a change in the performance of the ultraviolet interference filter, due to prolonged exposure of the filter to xenon arc radiation.

The addition of tin oxide to fused quartz to provide a quartz ultraviolet absorbing filter having a sharp cut-off at 2800A is described by Maddock in J. Soc. Glass Tech., 23, 372–377 (1939). However, relatively low concentrations of tin oxide were used, and only a very low wavelength portion of the spectrum, of no interest for solar simulation, was effectively modified.

It is a principal object of the present invention to provide a solar simulator which closely approximates average terrestrial sunlight, particularly in the violet and ultra-violet portions of the spectrum, but which utilizes an ultraviolet filter which is both optically stable and inexpensive to produce.

It is a further object of the invention to provide a glass absorption filter which, when used in combination with a xenon arc, provides filtered light closely approximating that of terrestrial sunlight.

Other objects and advantages of the invention will become apparent from the following detailed description thereof.

SUMMARY OF THE INVENTION

The solar simulator of the present invention comprises a xenon arc light source and a novel glass ultraviolet absorption filter. Together these components accurately reproduce the violet and ultraviolet portions of the solar spectrum, for average terrestrial sunlight conditions. Specifically, a close approximation to sunlight is obtained over the 0.3–0.46 micron wavelength range encompassing both the violet and ultraviolet regions.

The ultraviolet absorption filter utilized in the solar simulator of the invention is composed of a transparent base glass, to which has been added the ultraviolet absorbing ingredient tin oxide. The tin oxide acts to absorb xenon arc radiation of a wavelength below about 0.3 microns and in addition shapes the output of the arc above 0.3 microns to approximate the solar distribution. This ingredient is added to the filter glass in at least an amount effective to reduce the irradiance of the simulator at wavelengths below about 0.3 microns to less than 1% of the average irradiance of the simulator in the visible range. Thus negligible power is emitted by the simulator below this wavelength.

As an unexpected consequence of using tin oxide to absorb the unwanted ultraviolet radiation generated by the xenon arc, an excellent correspondence with terrestrial sunlight in the 0.3–0.46 micron wavelength range is provided. Although a satisfactory cutoff of wavelengths below 0.3 microns may be obtained using prior art filters, good correspondence with sunlight at longer ultraviolet wavelengths is difficult to obtain.

As an additional advantage, a filter provided in accordance with the invention can closely simulate the solar spectrum for a variety of air mass values, simply by adjusting the thickness of the glass. Hence, the attenuation of the atmosphere in the near ultraviolet closely follows Bar's Law, as does the filter glass containing $SnO_2$ as an ultraviolet absorbing agent.

The composition of the transparent base glass used to form the simulator filter is not critical, provided that the base glass exhibits good visible and ultraviolet light transmission in the absence of the tin oxide absorber. The use of a transparent base glass which, when free of tin oxide, has an absorption coefficient not exceeding about 25 $cm^{-1}$ at an ultraviolet wavelength of about 0.33 microns, will insure that the ultraviolet absorption characteristics of the filter will be governed primarily by the added tin oxide, rather than by the base glass.

DESCRIPTION OF THE DRAWING

The invention may be further understood by reference to the drawing which consists of a graph illustrating and comparing the spectral characteristics of terrestrial sunlight and light emitted by a solar simulator within the scope of the invention. The horizontal axis of the graph plots the wavelength of the light, while the vertical axis plots the relative intensity of the light as a function of wavelength. The close match between the spectral curves for the simulator and sunlight in the 0.3–0.46 wavelength range is evident.

DETAILED DESCRIPTION

The xenon arc utilized as a light source in the simulator of the invention may be any of the conventional lamps utilized in the prior art for this purpose. The power of the lamp is selected in accordance with the output requirements of the simulator. Normally, an arc lamp of sufficient power to provide a beam of useful size at an irradiance level in the visible range (0.4–0.7 μm) corresponding to that of terrestrial sunlight (averaging about 1050 $W \cdot m^{-2} \cdot \mu m^{-1}$ for air mass 2) is selected.

Although the filter may be composed of essentially any transparent glass, it is desirable to select a glass having reasonably good chemical durability in order to minimize deterioration in use. One of the principal advantages of such a filter is excellent long-term stability, characterized by essentially unchanging absorption characteristics despite prolonged exposure to ultraviolet xenon radiation. Through the proper selection of a transparent base glass composition for the filter, unnecessary degradation problems relating to loss of glass surface quality may readily be avoided.

One useful family of glass compositions for this application comprises alkali silicate glasses such as, for example, the alkali borosilicate and alkali boroaluminosilicate glasses. A specific illustrative example representing the properties of such a glass is a base glass consisting of about 26 parts $Na_2O$, 4 parts $B_2O_3$, 2 parts $Al_2O_3$ and 64 parts $SiO_2$ by weight. This glass exhibits good chemical durability, an expansion coefficient on the order of about $80 \times 10^{-7}/°$ C., and a linear absorption coefficient at 0.33 μm of about 0.4 $cm^{-1}$. Of course, other glasses of this type, or other types of glasses exhibiting different properties desired for a particular filter application, may alternatively be employed.

The addition of tin oxide to the filter glass to reduce the ultraviolet transmittance thereof is accomplished by adding tin oxide or another compound containing tin to a glass-forming batch for the filter glass, in an amount which will provide the desired concentration of tin oxide in the glass product. The amount of tin oxide required to obtain the necessary ultraviolet absorption effect will depend on the thickness of the filter and the power of the light source, but will normally range from a minimum of about 1% up to about 10% or more by weight of the glass. For conventional filter thicknesses and commercially-available arc lamps, tin oxide concentrations of about 2–8% $SnO_2$ by weight, as determined by analysis of the filter glass, will ordinarily be preferred. Such concentrations will normally be sufficient to reduce simulator irradiance at wavelengths below 0.3 μm to less than 1% of the average irradiance in the visible (e.g., to less than 10.5 $W \cdot m^{-2} \cdot \mu m^{-1}$ below 0.3 μm for a beam averaging 1050 $W \cdot m^{-2} \cdot \mu m^{-1}$ over the 0.4–0.7 μm wavelength range).

As is well known, some volatilization or phase separation of glass batch constituents may occur during glass melting, such that the composition of the batch may have to be adjusted in order to optimize glass quality or to achieve a target concentration of a particular oxide component in the finished glass. The control of such variables and the adjustment of batch composition to compensate therefor are matters well within the skill of a competent glass technologist. Similarly, the steps of forming a glass filter from molten glass by shaping, cutting, grinding, and polishing the glass may be carried out in accordance with conventional and well-known glass manufacturing techniques.

The invention may be further understood by reference to the following illustrative example showing the manufacture of a filter and simulator in accordance therewith.

EXAMPLE

A batch for an ultraviolet filter glass having the composition set forth in Table I below is compounded, ball-milled to assure glass homogeneity, and heated in a silica crucible in a glass melting furnace at 1300° C. for 4 hours.

TABLE I

Batch Composition 100 parts by weight sand
3 parts by weight aluminum oxide
5 parts by weight boric oxide
20 parts by weight sodium nitrate
60 parts by weight sodium carbonate
6 parts by weight tin oxide The molten glass thus provided is cast into a glass plate about 10 × 10 × 1 cm in size, placed in an annealing oven operating at 500° C., and slowly cooled to room temperature. The resulting glass plate is clear and transparent, exhibiting a slight yellow coloration when viewed in transmitted light. The analyzed composition of the glass plate is about 63.8% $SiO_2$, 4.4% $B_2O_3$, 2.3% $Al_2O_3$, 25.8% $Na_2O$ and 3.7% $SnO_2$ by weight.

A glass ultraviolet filter plate is provided by cutting, grinding and polishing the cast plate to a thickness of 7 mm and outer dimensions of 5 × 5 cm. This ultraviolet filter plate is then positioned in front of the output port of a metal-housed 150-watt xenon arc lamp, together with an infrared filter of the known type comprising a water-filled chamber of 3.5 cm path length. The spectral output of the operating lamp as modified by the filters may then be analyzed or calculated.

A plot of relative simulator output as a function of output wavelength, together with a similar plot approximating the terrestrial solar spectrum under average sunlight conditions (air mass 2), is reproduced in the drawing. Both plots are normalized to approximately the same total irradiated energy over the 0.3–2.0 micron wavelength range shown.

The terrestrial solar spectrum shown corresponds to that reported by P. Moon in J. Franklin Inst., 230, 583 (1940), while the simulator spectrum is calculated from the known output of the housed xenon arc lamp and the measured absorption curve of the glass over the wavelength range shown. The arc lamp utilized is commercially available from the Schoeffel Instrument Corporation, Westwood, New Jersey, which supplies detailed spectral output data for this product.

The calculations and selected confirming measurements indicate close agreement between the solar and the solar simulator spectra in the 0.3–0.46 μm wavelength range of particular interest. The simulator effectively duplicates the cutoff observed in the solar spectrum at about 0.3 μm, and the intensity of ultraviolet and violet radiation emitted by the simulator is not significantly higher than the intensity of the corresponding wavelengths in sunlight.

Although the spectral fit deteriorates somewhat between 0.46 and 6 μm and is not close in the far infrared, it may be considerably improved at these wavelengths, for example, through the use of selective infrared-transmitting mirrors or thin dissolved copper sulfate filters. However, such improvements are often of secondary importance since the main difficulty and primary objective is to obtain a good fit in the ultraviolet portion of the spectrum. Solar simulators are most useful in testing materials degradation (chemical bond breakage), which occurs with much higher probability as the wavelength of light decreases. Thus it is of paramount importance in the great majority of cases to give primary attention to this part of the spectrum.

A solar simulator such as described in the Example may be employed, for example, in testing the darkening characteristics of photochromic glass. Silver halide-containing photochromic glasses absorb strongly in the ultraviolet, and the darkened transmittance and appearance of such glasses depend in part on darkening conditions and in part on bleaching by longer wavelengths in the 6–8 μm range. It is found that the solar simulator of the invention duplicates solar darkening conditions with sufficient accuracy to fully reproduce the darkened transmittance and appearance of sunlight-darkened photochromic glass. Such a result is not obtained using darkening sources such as xenon and/or mercury arc lamps, or fluorescent ultraviolet lamps.

Of course it will be recognized that the simulator of the Example is merely illustrative of solar simulator configurations which could be developed in accordance with the invention; obviously numerous variations and modifications in structure may be resorted to within the scope of the appended claims. Thus, for example, it is possible to eliminate water as the commonly used infrared filter for certain applications, or, as previously noted, to improve filtration through the use of dissolved salts and/or dichroic mirrors, in order to obtain better correspondence with the solar spectrum in the infrared wavelength range. Nevertheless, the desirable emission characteristics of the simulator in the ultraviolet region, and the advantages of such characteristics for the testing of organic and inorganic materials strongly affected by ultraviolet light, are clearly apparent.

We claim:

1. A solar simulator comprising, in combination, a xenon arc light source and a glass ultraviolet absorption filter for filtering ultraviolet light from the xenon arc light source prior to use, wherein the glass filter is composed of a transparent base glass having an absorption coefficient at a wavelength of about 0.33 microns not exceeding about 25 $cm^{-1}$, to which base glass has been added tin oxide in at least an amount effective to reduce the irradiance of the simulator at wavelengths below 0.3 microns to less than 1% of the average irradiance of the simulator in the visible range.

2. A solar simulator in accordance with claim 1 wherein the glass ultraviolet absorption filter is composed of an alkali silicate base glass containing 1–10% $SnO_2$ by weight.

3. A solar simulator in accordance with claim 2 wherein the glass ultraviolet absorption filter is composed of an alkali boroaluminosilicate base glass containing 2–8% $SnO_2$ by weight.

* * * * *